US007720239B2

(12) United States Patent
Akino

(10) Patent No.: US 7,720,239 B2
(45) Date of Patent: May 18, 2010

(54) CAPACITOR MICROPHONE WITH ACOUSTIC RESISTOR

(75) Inventor: Hiroshi Akino, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 1048 days.

(21) Appl. No.: 11/247,280

(22) Filed: Oct. 12, 2005

(65) Prior Publication Data

US 2006/0109990 A1 May 25, 2006

(30) Foreign Application Priority Data

Nov. 25, 2004 (JP) ..... 2004-339946

(51) Int. Cl.

| | |
|---|---|
| ***H04R 25/00*** | (2006.01) |
| *H04R 9/08* | (2006.01) |
| *H04R 11/04* | (2006.01) |
| *H04R 17/02* | (2006.01) |
| *H04R 19/04* | (2006.01) |
| *H04R 21/02* | (2006.01) |

(52) U.S. Cl. ..... 381/174; 381/369

(58) Field of Classification Search ..... 381/174, 381/369

See application file for complete search history.

(56) References Cited

U.S. PATENT DOCUMENTS 7,136,500 B2 * 11/2006 Collins ..... 381/369

FOREIGN PATENT DOCUMENTS

| | | |
|---|---|---|
| JP | 2-66095 | 5/1990 |
| JP | 03-165693 | 7/1991 |
| JP | 5-7398 | 1/1993 |
| JP | 2000-232700 | 8/2000 |
| JP | 2000-340981 | 12/2000 |
| JP | 2004-007330 | 1/2004 |
| JP | 2004-328232 | 11/2004 |

* cited by examiner

*Primary Examiner*—Curtis Kuntz
*Assistant Examiner*—Matthew Eason
(74) *Attorney, Agent, or Firm*—Oblon, Spivak, McClelland, Maier & Neustadt, L.L.P.

(57) ABSTRACT

A capacitor microphone includes a microphone unit having one acoustic terminal or more than one acoustic terminals at one end or opposite ends thereof; an acoustic resistor provided near the acoustic terminal or near one of the acoustic terminals; and a case housing the microphone unit. The acoustic resistor is constituted by a conductive elastic material such as a woven or nonwoven fabric of metal threads, and is electrically connected to the microphone unit and the case.

5 Claims, 4 Drawing Sheets

CAPACITOR MICROPHONE WITH ACOUSTIC RESISTOR

CROSS REFERENCE TO RELATED APPLICATIONS

This application is based upon and claims the benefit of priority from prior Japanese Patent Application No. 2004-339,946 filed on or around Nov. 25, 2004; the entire contents of which are incorporated by reference herein.

BACKGROUND OF THE INVENTION

1. Field of the Invention

This invention relates to a capacitor microphone, and more particularly relates to a capacitor microphone which can efficiently prevent noises caused by outside electromagnetic waves and wind noises.

2. Description of the Related Art

Generally, a microphone unit for a capacitor microphone has high impedance, and includes an impedance transformer in order to reduce impedance of voice signals. The impedance-reduced voice signals are then transmitted to a low-cut circuit and an output circuit. In order to make a tiepin or headset type microphone less visible, a microphone unit usually houses only an impedance transformer while a low-cut circuit and an output circuit are housed in a circuit housing. The microphone unit and the circuit housing are connected by a dedicated cable.

The microphone unit is provided with an acoustic terminal via which sound waves are received. A nondirectional microphone needs one acoustic terminal while a unidirectional microphone of a primary sound pressure gradient type needs a pair of acoustic terminals at its front and rear ends. (Refer to Japanese Patent Laid-Open Publications No. 2000-232,700 and No. Hei 05-007,398).

FIG. 3 of the accompanying drawings shows a microphone unit 4 of a capacitor microphone of the related art. The microphone unit 4 is housed in a cylindrical case 2, and includes an acoustic terminal 10 at its front end. An acoustic resistor 8 made of a urethane sponge is housed in a front end of the cylindrical case 2, and has its one side in close contact with the acoustic terminal 10. A wire netting 6 is fixedly attached to the front end of the cylindrical case 2 in order to assure static shielding. The wire netting 6 is pressed in the shape of a cup having a flat bottom, and is fitted into the cylindrical case 2 with its straight sides 61 extending over the inner surface of the acoustic resistor 8. Referring to FIG. 4, the straight sides 61 of the wire netting 6 and the inner surface of the case 2 are brought into contact with one another at several points, thereby forming electric contacts 12. A rear peripheral edge of the cylindrical case 2 is crimped or is subject to the drawing compound in order to prevent the microphone unit 4 from dropping off. A cord (not shown) extends out of the rear end of the cylindrical case 2.

The acoustic terminal 10 of the microphone unit 4 is statically shielded by the wire netting 6 as shown in FIG. 3 and FIG. 4. However, the wire netting 6 is attached to the cylindrical case 2 using a rubber adhesive or the like, and is electrically connected to the cylindrical case 2 only via a plurality of points. This means that the electric connection is unreliable between the wire netting 6 and the cylindrical case 2, and that the static shielding also becomes unreliable. If outside electromagnetic waves arrive at an area where static shielding is unreliable, a high frequency current will flow through an internal circuit, be detected by a semiconductor element, and cause noises. Specifically, as cellular phones become popular and are more frequently used near a microphone, the microphone often suffers from noises caused by electric waves of the cellular phones.

Further, when airflows caused by winds or voices, especially airflows caused by plosive sounds, strike on the acoustic terminal 10 of the microphone unit 4, wind noises or pops will be produced. Usually, the acoustic resistor 8 is attached to the acoustic terminal 10, and is made of a fabric or a sponge, which has acoustic resistance but is non-conductive. If such an acoustic resistor 8 is used, the foregoing unreliable electric connection between the wire netting 6 and the cylindrical case 2 becomes further unstable, which will make the static shielding less reliable. This will cause more noises resulting from electromagnetic waves.

SUMMARY OF THE INVENTION

The invention is contemplated in order to overcome the foregoing problems of the related art. According to the invention, a shield structure is devised in order to electrically connect a microphone case and a microphone unit at a plurality of points. This shield structure is effective in reliably preventing not only electromagnetic waves from getting into the microphone unit but also wind noises. Further, the shield structure has an acoustic resistance, which is effective in preventing pops as well as wind noises.

According to the invention, there is provided a capacitor microphone which includes a microphone unit having one acoustic terminal or more than one acoustic terminals at one end or opposite ends thereof; an acoustic resistor provided near the acoustic terminal or near one of the acoustic terminals; and a case housing the microphone unit. The acoustic resistor is constituted by a conductive elastic material such as a woven or nonwoven fabric of metal threads, and is electrically connected to the microphone unit and the case.

DETAILED DESCRIPTION OF THE INVENTION

The invention will be described with reference to an embodiment shown in FIG. 1 and FIG. 2. For convenience sake, the invention is described to be applied to an omnidirectional tiepin microphone. Needless to say, the invention is also applicable to a unidirectional microphone of primary sound pressure gradient type which includes a pair of acoustic terminals at opposite ends thereof.

Figure 1:
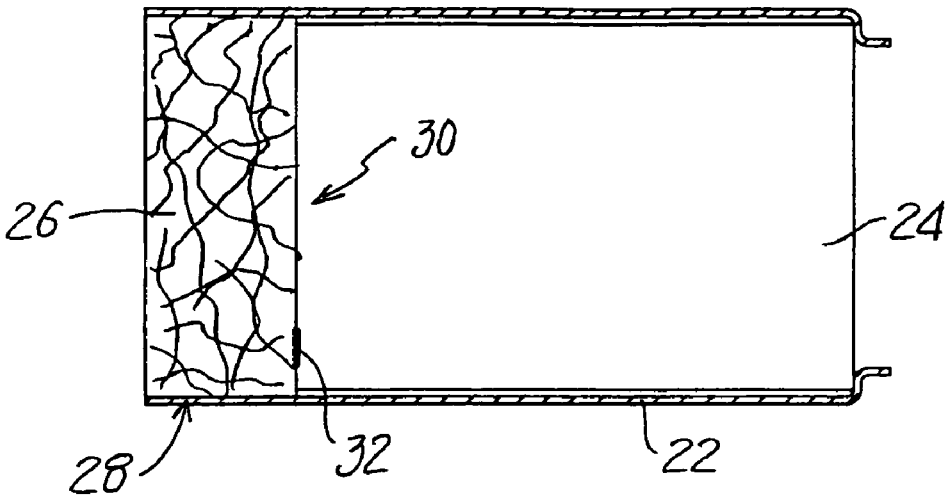
FIG. 1 is a longitudinal section of a capacitor microphone according to the invention.

Referring to FIG. 1, a capacitor microphone unit 24 is housed in a cylindrical case 22, and includes an acoustic terminal 30 at a front end thereof An acoustic resistor 26 is housed in a front end 28 of the cylindrical case 22, one end of which is in contact with the acoustic terminal 30.

Figure 2:
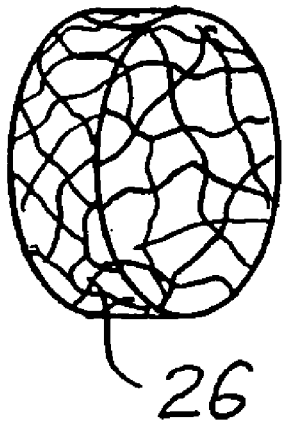
FIG. 2 is a perspective view of an acoustic resistor used in the capacitor microphone.
Figure 3:
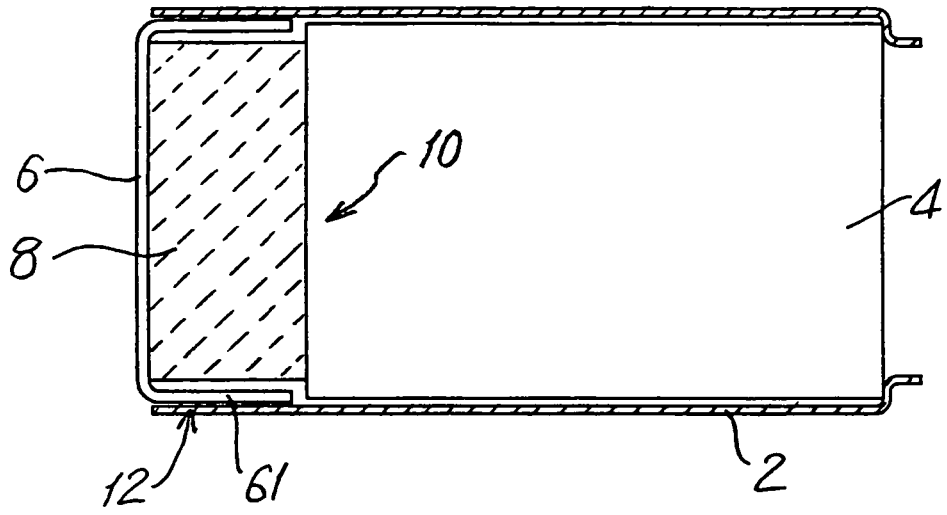
Fig. 3 (RELATED ART)
FIG. 3 is a longitudinal section of a capacitor microphone of the related art.
Figure 4:
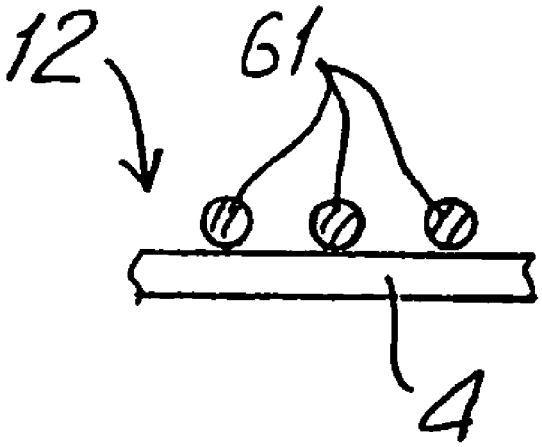
Fig. 4 (RELATED ART)
FIG. 4 is a cross section showing how the capacitor microphone of FIG. 3 is in contact with a microphone case.

As shown in FIG. 2, the acoustic resistor 26 is a disc made of conductive steel threads, for example. Preferably, the acoustic resistor 26 is made of stainless steel threads which are free from rusts or stains even with lapse of time. The conductive steel wires are woven into the shape of a fabric. The conductive steel fabric is pressed in the shape of a cup.

The acoustic resistor 26 made of such woven conductive steel fabric is flexible and porous, and prevents generation of noises caused by airflows. A conductive fabric "SUI-78-5010T" manufactured by Taiyou Mesh Co., Ltd. is available, for example.

The acoustic resistor 26 is fitted into the front end 28 of the cylindrical case 22, and has its rear end brought into contact with the acoustic terminal 30. The acoustic resistor 26 is thicker than the cylindrical case 22, is compressed and fitted into the front end 28 of the cylindrical case 22, expands therein, and comes into close contact with the inner surface of the case 22. The acoustic resistor 26 is electrically connected to the cylindrical case 22 and the microphone unit 24. One or more adhesive spots 32 are provided between the acoustic resistor 26 and the microphone unit 24 in order to keep them in close contact with each other. The acoustic resistor 26 and the microphone unit 24 are preferably in contact with each other via a large area, so that the adhesive spots 32 are made as few or small as possible.

An appropriate fastener or ring may be provided in order to prevent the acoustic resistor 26 from dropping off from the cylindrical case 22. Alternatively, the acoustic resistor 26 is partially fastened to the cylindrical case 22 using an adhesive. According to the invention, the rear peripheral edge of the cylindrical case 22 is crimped for the foregoing purpose. Further, a cord (not shown) extends out of the rear end of the cylindrical case 22.

As described above, the acoustic resistor 26 is present at the front end of the acoustic terminal 30 of the microphone unit 24, suppresses airflows caused by wind or pops, and prevents generation of wind noises, pops and so on.

The acoustic resistor 26 is made of the conductive material such as woven or non-woven metal threads, and is electrically connected to the cylindrical case 22, so that the acoustic resistor 26 also functions as the static shield to block outside electromagnetic waves coming from a nearby cellular phone and so on. This is effective in preventing generation of noises caused by the electromagnetic waves. Further, the capacitor microphone has a simple structure by reducing the number of components thereof.

What is claimed is:

1. A capacitor microphone comprising:

a microphone unit including one acoustic terminal or more than one acoustic terminals at one end or opposite ends thereof;

an acoustic resistor made of a conductive elastic material and provided near the acoustic terminal or near one of the acoustic terminals; and a case housing the microphone unit, wherein the acoustic resistor is a disc, the disc being thicker than the case in an uncompressed state, disposed in the case in a compressed state while in contact with an inner surface of the case, and electrically connects the microphone unit to the case at a plurality of points.

2. The capacitor microphone of claim 1, wherein the acoustic resistor is constituted by a woven fabric of metal threads, and also functions as a static shield.

3. The capacitor microphone of claim 1, wherein the acoustic resistor is constituted by a nonwoven fabric of metal threads, and also functions as a static shield.

4. The capacitor microphone of claim 1, wherein the acoustic resistor is a woven or nonwoven fabric of metal threads.

5. The capacitor microphone of any one of claims 1 to 4, wherein the acoustic resistor is made of stainless steel threads.

* * * * *